US008500176B2

(12) United States Patent
Marchand

(10) Patent No.: US 8,500,176 B2
(45) Date of Patent: Aug. 6, 2013

(54) INTERLOCKING ENGAGEMENT MECHANISM FOR AN ADJUSTABLE BENT HOUSING

(75) Inventor: Nicholas Ryan Marchand, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 679 days.

(21) Appl. No.: 12/635,501

(22) Filed: Dec. 10, 2009

(65) Prior Publication Data

US 2011/0140411 A1 Jun. 16, 2011

(51) Int. Cl.
*F16L 21/00* (2006.01)

(52) U.S. Cl.
USPC ..... 285/397; 285/86; 285/330; 285/913

(58) Field of Classification Search
USPC ..... 285/81–82, 86, 92, 330, 376, 401, 285/403–404, 397, 913
See application file for complete search history.

(56) References Cited

U.S. PATENT DOCUMENTS 4,077,657 A * 3/1978 Trzeciak ..... 285/184
4,303,135 A * 12/1981 Benoit ..... 175/73
4,813,497 A * 3/1989 Wenzel ..... 175/74
5,125,463 A 6/1992 Livingston et al.
5,248,004 A * 9/1993 Witte ..... 175/74
5,343,966 A 9/1994 Wenzel et al.
6,516,901 B1 2/2003 Falgout, Sr.
6,550,818 B2 4/2003 Robin
7,104,345 B2 * 9/2006 Eppink ..... 175/61
7,216,726 B2 * 5/2007 Swietlik et al. ..... 175/73
7,377,316 B2 * 5/2008 Boyd ..... 166/242.5
2007/0095575 A1 5/2007 Johnson et al.

* cited by examiner

*Primary Examiner* — Aaron Dunwoody
*Assistant Examiner* — Fannie Kee
(74) *Attorney, Agent, or Firm* — Conley Rose, P.C.

(57) ABSTRACT

An adjustable bent housing includes a tubular member with a first engagement means and an adjustment ring with a second engagement means. The first engagement means has a plurality of sockets in a first region of the annular end face of the tubular member, and a plurality of locking pins projecting from a second region of the end face. The second engagement means has a plurality of sockets in an annular end face of the adjustment ring, configured to receive the locking pins. The second engagement means further includes an indexing pin projecting from the adjustment ring end face, and receivable within any socket of the first engagement means when the locking pins are disposed within corresponding sockets of the second engagement means. The adjustment ring is longitudinally movable relative to the tubular member to permit relative rotational adjustment therebetween and configured to prevent over-rotation of the adjustment ring.

27 Claims, 6 Drawing Sheets

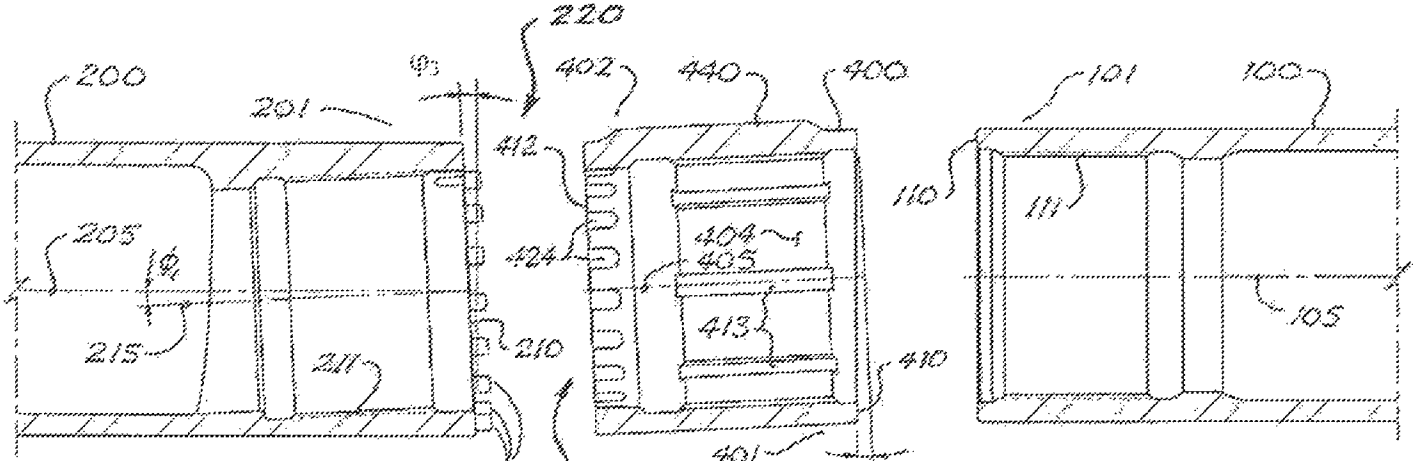
FIGURE 2C
FIGURE 2B
FIGURE 2A
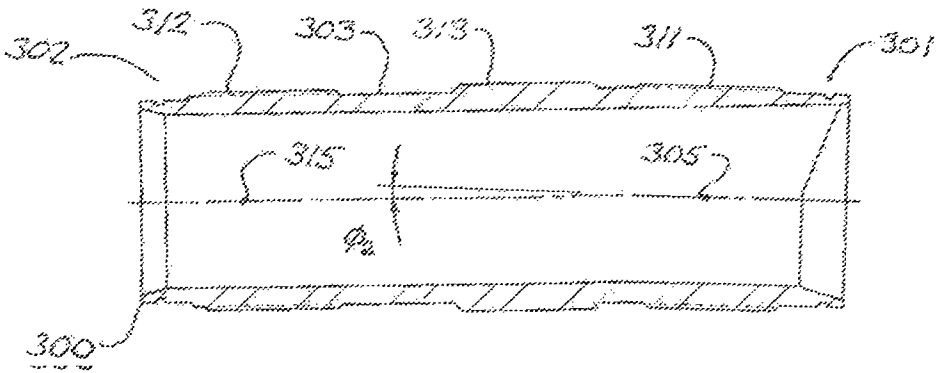
FIGURE 2D

INTERLOCKING ENGAGEMENT MECHANISM FOR AN ADJUSTABLE BENT HOUSING

FIELD OF THE DISCLOSURE

The present disclosure relates in general to adjustable bent housing assemblies for deviating a drill string during directional drilling of a wellbore. In particular, the disclosure relates to means for releasably interlocking components of an adjustable bent housing assembly at a desired bend angle.

BACKGROUND

In drilling a borehole (or wellbore) into the earth, such as for the recovery of hydrocarbons or minerals from a subsurface formation, it is conventional practice to connect a drill bit onto the lower end of an assembly of drill pipe sections connected end-to-end (commonly referred to as a "drill string"), and then rotate the drill string so that the drill bit progresses downward into the earth to create the desired borehole. In conventional vertical borehole drilling operations, the drill string and bit are rotated by means of either a "rotary table" or a "top drive" associated with a drilling rig erected at the ground surface over the borehole (or, in offshore drilling operations, on a seabed-supported drilling platform or suitably-adapted floating vessel).

During the drilling process, a drilling fluid (also commonly referred to in the industry as "drilling mud", or simply "mud") is pumped under pressure downward from the surface through the drill string, out the drill bit into the borehole, and then upward back to the surface through the annular space between the drill string and the wellbore. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

Particularly since the mid-1980s, it has become increasingly common and desirable in the oil and gas industry to drill horizontal and other non-vertical boreholes (i.e., "directional drilling"), to facilitate more efficient access to and production from larger regions of subsurface hydrocarbon-bearing formations than would be possible using only vertical boreholes. In directional drilling, specialized drill string components and "bottom hole assemblies" are used to induce, monitor, and control deviations in the path of the drill bit, so as to produce a borehole of desired non-vertical configuration.

Directional drilling is typically carried out using a "downhole motor" (alternatively referred to as a "drilling motor" or "mud motor") incorporated into the drill string immediately above the drill bit. A typical downhole motor includes several primary components, as follows (in order, starting from the top of the motor assembly):

- a top sub adapted to facilitate connection to the lower end of a drill string ("sub" being the common general term in the oil and gas industry for any small or secondary drill string component);
- a power section comprising a positive displacement motor of well-known type, with a helically-vaned rotor eccentrically rotatable within a stator section;

- a drive shaft enclosed within a drive shaft housing, with the upper end of the drive shaft being operably connected to the rotor of the power section; and
- a bearing assembly (which includes a mandrel with an upper end coupled to the lower end of the drive shaft, plus a lower end adapted to receive a drill bit).

In drilling processes using a downhole motor, drilling fluid is circulated under pressure through the drill string and back up to the surface as in conventional drilling methods. However, the pressurized drilling fluid exiting the lower end of the drill pipe is diverted through the power section of the downhole motor to generate power to rotate the drill bit.

In directional drilling, the path of the drill bit is deviated in a desired direction by means of a bent housing or a bent sub, typically disposed between the power section and the bearing assembly of a downhole motor. Bent subs and bent housings serve the same purpose, and in general terms differ only in that a bent housing is adapted to accommodate a drive shaft through its central bore. Although bent subs and bent housings may be fashioned with a fixed bend angle, it is commonly advantageous for a bent housing or bent sub to comprise an assembly of components whereby the bend angle is adjustable between being zero and some maximum bend angle.

Examples of known types of adjustable bent housings and bent subs may be seen in U.S. Pat. No. 5,125,463 (Livingstone et al.), U.S. Pat. No. 5,343,966 (Wenzel et al.), U.S. Pat. No. 6,515,901 (Falgout, Sr.), U.S. Pat. No. 6,550,818 (Robin), and Patent Publication No. US 2007/0095575 (Johnson et al.).

A typical adjustable bent housing comprises first and second tubular members separated by a tubular sleeve (or "adjustment ring", as this element will be referred to herein), arranged in a generally end-to-end configuration and disposed about an internal tubular element of some type. A primary distinguishing feature of a typical adjustable bent housing is that each end of the adjustment ring is engageable with an end of either the first or second tubular member such that the centroidal axis of the adjustment ring is not coincident with the centroidal axis of either the first or the second tubular member, but is in each case angularly offset by a selected offset angle. As described in further detail later herein, this allows for angular adjustment of the first tubular member relative to the second tubular member so as to orient the centroidal axes of the first and second tubular members at a selected bend angle between zero and the sum of the offset angles (or twice the offset angle if, as is typically the case, the same offset angle is used at each end of the adjustment ring).

In one exemplary configuration of an adjustable bent housing, the first tubular member has a first end with a planar annular first end face, a second end, and a centroidal axis. The plane of the first end face of the first tubular member is perpendicular to the centroidal axis thereof. The second tubular member has a first end, a second end, and a centroidal axis. The first end of the second tubular member defines a first clutch profile, the general plane of which is offset from a plane perpendicular to the centroidal axis of the second tubular member by an offset angle $\phi$ (phi).

The adjustment ring has a first end, a second end, and a centroidal axis. The first end of the adjustment ring has a planar annular first end face, the plane of which is offset from a plane perpendicular to the centroidal axis of the adjustment ring by offset angle $\phi$. In the assembled bent housing, the first end face of the adjustment ring is matingly engageable with the planar annular end face of the first end of the first tubular member.

The second end of the adjustment ring defines a second clutch profile, the general plane of which is perpendicular to the centroidal axis of the adjustment ring, and which in the assembled bent housing is engageable with the first clutch profile at the first end of the second tubular member, for rotationally locking the second tubular member relative to the adjustment ring.

The first and second tubular members and the adjustment ring are disposed about an internal tubular member such that a first end of the internal tubular member extends into the first tubular member, and a second end of the internal tubular member extends into the second tubular member. The internal tubular member has a first centroidal axis associated with the first end of the internal tubular member, and a second centroidal axis associated with the second end of the internal tubular member, with the first and second centroidal axes being angularly offset, and intersecting in a medial region of the internal tubular member.

The first end of the internal tubular member has external threading engageable with internal threading in the first end of the first tubular member, such that in the assembled housing, the first centroidal axis of the internal tubular member will be coincident with the centroidal axis of the first tubular member.

The second end of the internal tubular member has external threading engageable with internal threading in the first end of the second tubular member. However, the internal threading in the first end of the second tubular member is concentric not with the centroidal axis of the second tubular member but is instead concentric with a non-centroidal secondary axis (or "skew axis) offset from the centroidal axis of the second tubular member, such that in the assembled housing, the skew axis will be coincident with the second centroidal axis of the internal tubular member. The magnitude of the offset between the skew axis and the centroidal axis of the second tubular member will typically be equal to offset angle $\phi$.

The adjustment ring is longitudinally and non-rotatingly slidable along a medial portion of the internal tubular member, typically by means of a splined connection between these two components.

The angular variance between the centroidal axes of the first and second tubular members (herein referred to as the bend angle $\theta$ (theta) of the bent housing assembly) can be adjusted by rotating the first tubular member (typically counterclockwise) relative to the internal tubular member so as to separate the first faces of the first tubular member and the adjustment ring, thus allowing sliding movement of the adjustment ring along the internal tubular member toward the first tubular member so as to disengage the first and second clutch profiles. The bend angle can then be adjusted by rotating the adjustment ring so as to change the angular relationship between the clutch profiles, which can then be re-engaged by sliding the adjustment ring back toward the second tubular member. The first tubular member is then rotated (typically clockwise) to tighten its first end face against the first end face of the adjustment ring.

Because the adjustment ring is non-rotatable relative to the inner tubular member, rotation of the adjustment ring relative to the second tubular member results in the same angular rotation of the inner tubular member relative to the second tubular member, and a corresponding adjustment to the bend angle of the bent housing (because the angular relationship between the first tubular member and the internal tubular member remains constant). Depending on the degree of relative rotation between the inner and second tubular members, the bend angle can be set anywhere between zero degrees and twice the offset angle. For example, if the offset angle is 1.5 degrees, the bent housing assembly's maximum bend angle will be 3.0 degrees.

The preceding discussion describes only one possible configuration for adjustable bent housings. One or more alternative structural configurations could be used to achieve substantially the same functionality.

Adjustable bent housings currently in use employ a variety of different clutch mechanisms to lock the assembly at a desired bend angle. A typical example would be mating clutch mechanisms featuring circumferentially-spaced square or angled teeth formed in the first end of the second tubular member and the second end of the adjustment ring. These teeth act as a clutch in that relative rotation between the first and second tubular members is prevented when the teeth are engaged, but relative rotation is freely enabled when the teeth are disengaged. As components of the bent housing assembly are unthreaded during adjustment of the bend angle, such relative rotation sometimes exceeds what is required to traverse the housing's full range of bend angle settings. This can result in housing components being put out of proper axial alignment after making a bend angle adjustment. If the axial misalignment is great enough, during subsequent re-torquing of the assembly the first end of the first tubular member can come into contact with the splines of the internal tubular member prior to the clutch mechanism becoming fully engaged. This subjects the clutch teeth to the full make-up torque, which can cause physical damage to the teeth. This also results in improper make-up of the connection because the make-up torque is transferred through the clutch teeth rather than pre-loading the internal tubular member and adjustment ring between the first and second tubular members. As is well known in the art, an improperly made-up threaded connection can result in fracture due to excessive bending stresses, as well as the potential for the connection to become unthreaded during operation.

For the foregoing reasons, there is a need for a clutch mechanism for interlocking engagement of tubular components of an adjustable bent housing which prevents relative over-rotation of housing components and resultant physical damage thereto.

SUMMARY

In general terms, the present disclosure is directed to an engagement mechanism for releasably interlocking the ends of a pair of rotatable members, with means for selectively adjusting the rotatable members' relative angular orientation when interlocked, within a selected angular range.

In a first embodiment, the engagement mechanism comprises a first engagement means at a first end of a tubular member forming part of an adjustable bent housing, and a second engagement means at one end (the "connection end") of a tubular adjustment ring forming part of the adjustable bent housing. The first engagement means features a plurality of sockets formed in a circular (or substantially circular) array in a first region of the annular end face of the tubular member, and a plurality of equally-spaced locking pins projecting from a second region of the annular end face of the tubular member. The plurality of sockets of the first engagement means is arranged such that the spacing of any socket relative to any locking pin corresponds to a multiple of the basic spacing interval between locking pins, or the plurality of sockets of the first engagement means may be staggered relative to the plurality of locking pins. It is to be understood that in this and analogous contexts in this patent document, the term "multiple" of the basic spacing interval means the basic spacing interval multiplied by an integer.

The second engagement means features a plurality of sockets formed in a circular (or substantially circular) array around the annular end face of the adjustment ring, and sized to receive the locking pins of the first engagement means. The second engagement means further comprises an indexing pin projecting from the annular end face of the connection end of the adjustment ring, and sized and located to be receivable within any of the sockets of the first engagement means. The indexing pin may be located between an adjacent pair of sockets of the second engagement means, or its spacing from any socket of the second engagement means may correspond to a multiple of the basic spacing interval between locking pins (depending on whether the locking pins are staggered relative to the sockets of the first engagement means). Whatever spacing relationship may be between the sockets and locking pins of the first engagement means, and between the indexing pin and adjacent sockets of the second engagement means, in the different embodiments of the assembly, the indexing pin will always be disposed within one of the sockets of the first engagement means when the locking pins of the first engagement means are disposed within a corresponding group of sockets of the second engagement means.

It should be noted that the term "socket", as used in this patent document, is to be interpreted as denoting a hole, opening, or recess into which a locking pin or an indexing pin (as the context requires) can be inserted, without restriction or limitation as to socket configuration or dimensions.

The adjustment ring is longitudinally movable relative to the tubular member, in a direction perpendicular to the end faces of the adjustment ring and the tubular member, to allow for disengagement of the first and second engagement means as well as relative rotational adjustment therebetween, in applications entailing such rotational adjustability. Preferably, however, the adjustment ring's range of travel relative to the tubular member is restricted such that the two outermost of the locking pins of the first engagement means will act as stops defining the limit of rotational travel for the indexing pin.

Accordingly, in a first aspect the present disclosure provides an interlocking engagement mechanism for rotationally engaging a first tubular member with a second tubular member, said first and second tubular members each having a first end and a planar annular end face, wherein the interlocking engagement mechanism comprises:

first engagement means comprising a plurality of sockets formed in a first region of the annular end face of the first tubular member; and a plurality of locking pins projecting from a second region of the annular end face of the first tubular member, said locking pins being arrayed in a circularly curved pattern at a radius "R" and equally spaced at an arcuate spacing "S";

second engagement means comprising a plurality of sockets formed in the annular end face of the second tubular member, said sockets being configured such that any locking pin of the first engagement means is receivable within any socket of the second engagement means, and an indexing pin projecting from the annular end face of the second tubular member, said indexing pin being configured to be receivable within any socket of the first engagement means; and means for allowing relative longitudinal movement and relative angular displacement between the first and second tubular members, to enable engagement and disengagement of the first and second engagement means;

such that whenever the indexing pin is disposed within a selected socket of the first engagement means, each locking pin will be disposed within a socket of the second engagement means.

In a second embodiment of the disclosure, an interlocking engagement mechanism in accordance with the present disclosure is incorporated into an adjustable bent housing. In this embodiment, the adjustable bent housing comprises:

a first tubular member having a first centroidal axis, a first end, and a planar annular first end face;

a second tubular member having a second centroidal axis, a skew axis offset from the second centroidal axis by a first offset angle, a first end, and a planar annular first end face incorporating first engagement means;

a tubular sleeve having a third centroidal axis, a first end, a planar annular first end face, a second end, and a planar annular second end face, said second end face incorporating second engagement means; and an internal tubular member having a first end, a first end portion, a second end, a second end portion, and a medial portion between said first and second portions;

wherein:

the tubular sleeve is disposed around the internal tubular member in association with means whereby the tubular sleeve is longitudinally movable but non-rotatable relative to the internal tubular member;

the first end of the internal tubular member has external threads engageable with mating internal threads in the first end of the first tubular member such that the first end face of the first tubular member is parallel to the first end face of the tubular sleeve; the first centroidal axis is offset from the skew axis by a first offset angle; and the first end face of the second tubular member is parallel to the second end face of the tubular sleeve;

the first engagement means comprises a plurality of sockets formed in a first region of the first end face of the second tubular member; and a plurality of locking pins projecting from a second region of the first end face of the second tubular member, said locking pins being arrayed in a circularly curved pattern at a radius "R" and equally spaced at an arcuate spacing "S";

the second engagement means comprises a plurality of sockets formed in the second end face of the tubular sleeve; and an indexing pin projecting from the second end face of the tubular sleeve;

each locking pin is receivable within any socket of the second engagement means; and the indexing pin is receivable within any socket of the first engagement means;

such that whenever the indexing pin is disposed within a socket of the first engagement means, each locking pin will be disposed within a socket of the second engagement means.

In a third embodiment, an interlocking engagement mechanism in accordance with the present disclosure is incorporated into an adjustable bent housing of a type as previously described herein, with the first engagement means being incorporated into the first end of the second tubular member of the adjustable bent housing. In this embodiment, the adjustable bent housing comprises:

a first tubular member having a first centroidal axis; a first end having a planar annular first end face perpendicular to the first centroidal axis; and first internal threads concentric with the first centroidal axis in a region of the first tubular member proximal to the first end thereof;

a second tubular member having a second centroidal axis; a first end having a planar annular first end face angularly offset from a plane perpendicular to the second centroidal axis by a first offset angle; a skew axis angularly offset the second centroidal axis by the first offset angle; second internal threads concentric with the skew axis in a region of the second tubular member proximal to the first end thereof; and first engagement means incorporated into the first end of the second tubular member;

a tubular sleeve having a third centroidal axis, a first end with a planar annular first end face, and a second end having a planar annular second end face; wherein the plane of the first end face of the tubular sleeve is angularly offset from a plane perpendicular to the third centroidal axis by a second offset angle, the plane of the second end face of the tubular sleeve is perpendicular to the third centroidal axis, and the second end of the tubular sleeve incorporates second engagement means engageable with the first engagement means; and an internal tubular member having a first end portion and a second end portion, plus a medial portion between the first and second portions, wherein the first portion has a fourth centroidal axis, and the second portion has a fifth centroidal axis angularly offset from the fourth centroidal axis by the second offset angle.

In this embodiment, the internal tubular member also has first external threads concentric with the fourth centroidal axis in a region proximal to the first end of the internal tubular member, with the first external threads being engageable with the first internal threading of the first tubular member; and second external threads concentric with the fifth centroidal axis in a region proximal to the second end of the internal tubular member, with the second external threads being engageable with the second internal threads of the second tubular member. The tubular sleeve is disposed around the internal tubular member with means provided whereby the tubular sleeve is non-rotatable and longitudinally movable relative to the internal tubular member.

In one variant of this embodiment of an adjustable bent housing, the first engagement means comprises:

a plurality of sockets formed in a first region of the first end face of the second tubular member; and a plurality of locking pins projecting from a second region of the first end face of the second tubular member, with the locking pins being centered at radius "R" from the second centroidal axis and equally spaced at arcuate spacing "S";

and the second engagement means comprises:

a plurality of sockets formed in the second end face of the tubular sleeve; and an indexing pin projecting from the second end face of the tubular sleeve.

In this embodiment, each locking pin is disposable within any socket of the second engagement means, and the indexing pin is disposable within any socket of the first engagement means, such that whenever the indexing pin is disposed within a socket of the first engagement means, each locking pin will be disposed within a socket of the second engagement means.

To provide this functionality, the sockets of the first engagement means of this embodiment are nominally centered at radius "R" from the second centroidal axis and nominally equally spaced at arcuate spacing "S"; and the sockets of the second engagement means will be nominally centered at radius "R" from the third centroidal axis and nominally equally spaced at arcuate spacing "S". In other words, although it may be convenient and desirable for the sockets of the first and second engagement means to be provided in a fairly precise circular array and at a fairly precise equal spacing, this is not critical or essential to the disclosure. In alternative embodiments, the layout of the sockets of either or both engagement means could exhibit a degree of geometric irregularity, and the extent of such permissible irregularity will be a function of the tolerance or "play" incorporated into the sockets (i.e., the extent to which the sockets are oversized relative to the indexing pin and/or locking pins).

In another variant of this embodiment of an adjustable bent housing, the first engagement means comprises:

a plurality of sockets formed in the first end face of the second tubular member; and an indexing pin projecting from the first end face of the second tubular member;

and the second engagement means comprises:

a plurality of sockets formed in a first region of the second end face of the tubular sleeve; and a plurality of locking pins projecting from a second region of the second end face of the tubular sleeve, with the locking pins being centered at a radius "R" from the third centroidal axis and equally spaced at arcuate spacing "S".

In this variant, each locking pin is disposable within any socket of the first engagement means, and the indexing pin is disposable within any socket of the second engagement means, such that whenever the indexing pin is disposed within a socket of the second engagement means, each locking pin will be disposed within a socket of the first engagement means.

It should be noted that the details of the adjustable bent housing in the above-described embodiments are exemplary only. A fundamentally important characteristic of an adjustable bent housing is that the second tubular member has a skew axis that is offset its centroidal axis, and that the centroidal axis of the first tubular element is offset the skew axis of the second tubular member. However, persons skilled in the art will appreciate that this characteristic can be provided in adjustable bent housings having configurations different from the described and illustrated embodiments.

BRIEF DESCRIPTION OF THE DRAWINGS

Embodiments of the disclosure will now be described with reference to the accompanying figures, in which numerical references denote like parts, and in which:

FIG. 2A is a cross-section through the first end of the second tubular member of an adjustable bent housing as in FIG. 1.

FIG. 2B is a cross-section through the adjustment ring of an adjustable bent housing as in FIG. 1.

FIG. 2C is a cross-section through the first end of the first tubular member of an adjustable bent housing as in FIG. 1.

FIG. 2D is a cross-section through the internal tubular member of an adjustable bent housing as in FIG. 1.

DETAILED DESCRIPTION

Figure 1:
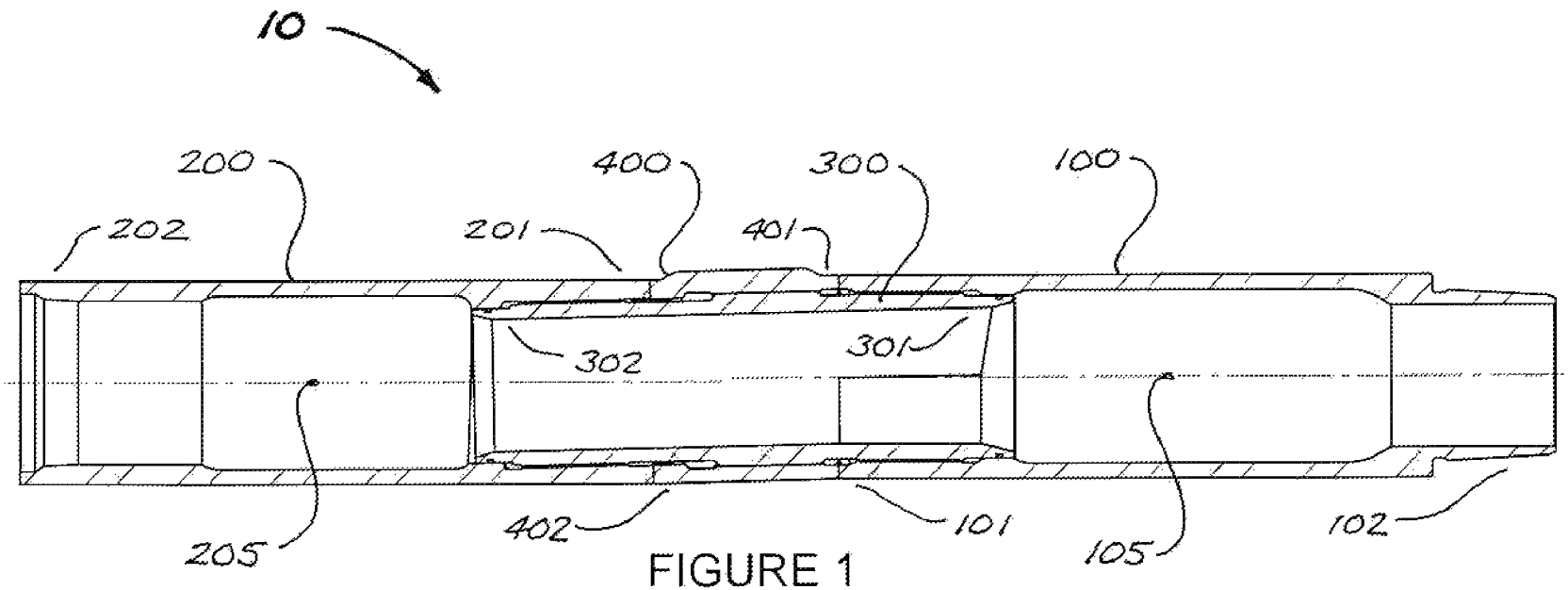
FIG. 1 is a longitudinal cross-section through an adjustable bent housing incorporating an interlocking engagement mechanism in accordance with an embodiment of the present disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational terms such as "parallel", "perpendicular", "planar", "coaxial", "coincident", "intersecting", "centered", "equal", and "equidistant" are not intended to denote or require absolute mathematical or geometrical precision. Accordingly, such terms are to be understood as denoting or requiring substantial precision only (e.g., "substantially parallel") unless the context clearly requires otherwise.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

The Figures illustrate an adjustable bent housing 10 incorporating an interlocking engagement mechanism in accordance with one embodiment of the present disclosure. In the illustrated embodiment, and as best seen in FIG. 1, bent housing 10 comprises:

- a first tubular member 100 having a centroidal axis 105 (also referred to herein as the first centroidal axis);
- a second tubular member 200 having a centroidal axis 205 (also referred to herein as the second centroidal axis) and a skew axis 215 offset from centroidal axis 205 by a first offset angle $\phi_1$;
- a tubular sleeve (or "adjustment ring") 400 having a centroidal axis 405 (also referred to herein as the third centroidal axis); and
- an internal tubular member 300 comprising a first end portion 301 having a centroidal axis 305 (also referred to herein as the fourth centroidal axis); a second end portion 302 having a centroidal axis 315 (also referred to herein as the fifth centroidal axis) angularly offset from first axis 305 by a second offset angle $\phi_2$; and a medial portion 303 between first and second end portions 301 and 302.

Particular geometric characteristics of these four components are illustrated in FIGS. 2A, 2B, 2C, and 2D (in which angular offsets are exaggerated for illustrative purposes), and described in more detail later herein.

First tubular member 100 has a first end 101 and a second end 102, with first end 101 having a planar annular end face 110 perpendicular to axis 105, and with second end 102 being adapted for connection to a downhole motor or other drill string component (such as by way of a "pin" connection as illustrated in FIG. 1). The bore of first tubular member 100 has first internal threads 111 concentric about axis 105 in a region adjacent to first end 101.

Figure 4:
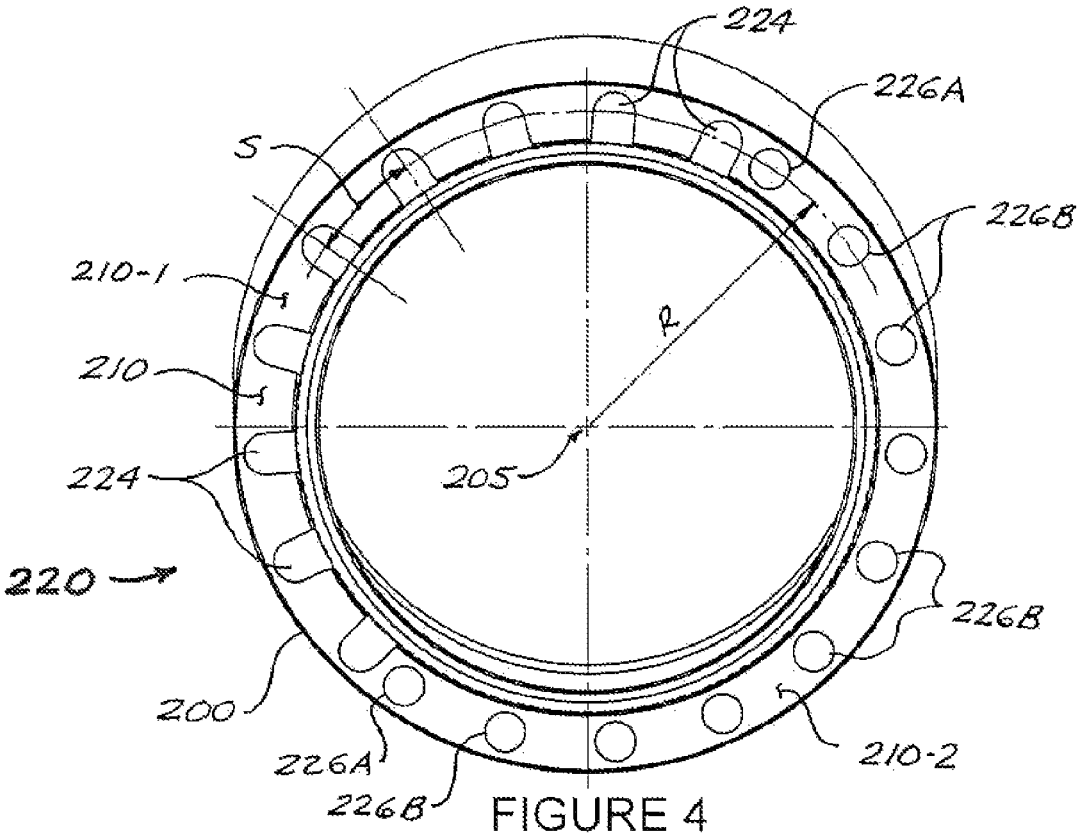
FIG. 4 is an end view of the first end of the second tubular member of an adjustable bent housing as in FIG. 1.
Figure 6:
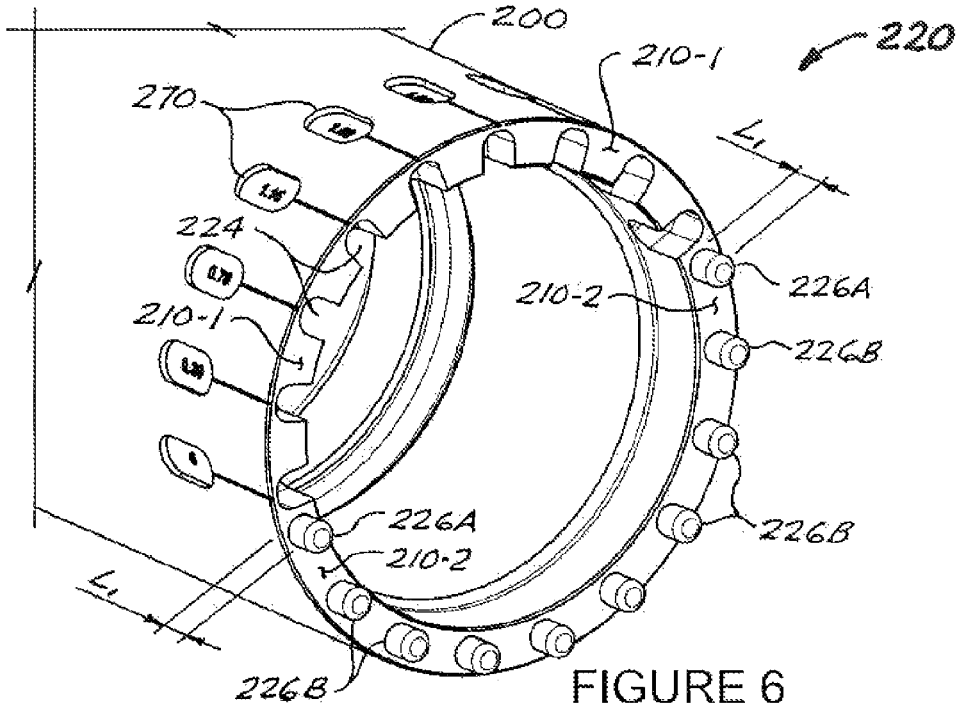
FIG. 6 is an isometric view of the first end of the second tubular member of an adjustable bent housing as in FIG. 1.

Second tubular member 200 has a first end 201 and a second end 202, with second end 202 being adapted for connection into a drill string (such as by way of a "box" connection as illustrated in FIG. 1). The bore of second tubular member 200 has second internal threads 211 concentric about skew axis 215 in a region adjacent to first end 201. First end 201 has a planar annular end face 210 which is oriented at a third offset angle $\phi_3$ relative to a plane perpendicularly transverse to second centroidal axis 205. For reference purposes, and as indicated in FIGS. 4 and 6, annular end face 210 may be considered as defining first and second regions 210-1 and 210-2, which will preferably but not necessarily be substantially equal in arcuate length (i.e., approximately semicircular). First end 201 incorporates a first engagement means 220 as illustrated in detail in FIGS. 4 and 6, and as will be described in detail later herein.

First end portion 301 of internal tubular member 300 has first external threads 311 which are engageable with first internal threads 111 of first tubular member 100, whereupon axis 305 of internal tubular member 300 will be coincident with axis 105 of first tubular member 100. Second end portion 302 of internal tubular member 300 has second external threads 312 which are engageable with second internal threads 211 of second tubular member 200. Longitudinal splines 313 project radially outward from the outer surface 304 of medial portion 303 of internal tubular member 300.

Adjustment ring 400 has a first end 401 with an annular first end face 410, plus second end 402. First end face 410 is substantially planar, and is oriented at a fourth offset angle $\phi_4$ relative to axis 405, for mating engagement with end face 110 of first tubular member 100. The fourth offset angle $\phi_4$ will typically and most conveniently be equal to the third offset angle $\phi_3$, but this is not essential. In alternative embodiments, third offset angle $\phi_3$ and the fourth offset angle $\phi_4$ could have different values.

Figure 7:
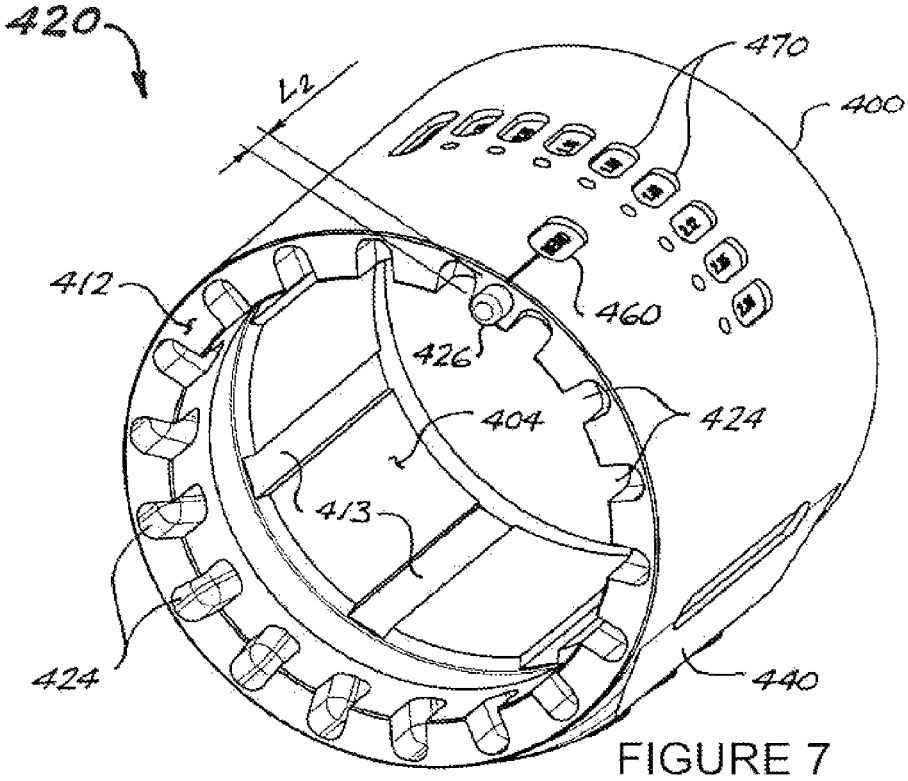
FIG. 7 is an isometric view of the second end of the adjustment ring of an adjustable bent housing as in FIG. 1.

Second end 402 of adjustment ring 400 has an annular second end face 412 lying in a plane perpendicular to axis 405, and incorporates a second engagement means 420 as illustrated in detail in FIGS. 5 and 7 (and as will be described in detail later herein), for operative engagement with first engagement means 220 at first end 201 of second tubular member 200. Longitudinal grooves 413 are formed in the inner surface 404 of adjustment ring 400 (as best seen in FIG. 7), for sliding engagement with mating splines 313 of internal tubular member 300. Splines 313 and grooves 413 are configured such that adjustment ring 400 is non-rotatingly movable longitudinally along internal tubular member 300 (within a limited travel range 450 as explained later herein) toward first tubular member 100 without interference with external threads 311 on internal tubular member 300.

The spline-and-groove arrangement described and illustrated in this patent document represents only one means by which adjustment ring 400 can be made both non-rotatable and longitudinally movable relative to internal tubular member 300. Persons skilled in the art will appreciate that alternative means can be devised for providing this functionality, and the present disclosure is not restricted or limited to use of the disclosed spline-and-groove arrangement for this purpose.

In the assembled housing 10, end face 410 of adjustment ring 400 will be perpendicular to axis 305 of internal tubular member 300 and, in turn, to axis 105 of first tubular member 100, by virtue of the aforementioned coincidence of axes 305 and 105. Accordingly, end face 110 of first tubular member 100 and first end face 410 of adjustment ring 400 will be parallel, and will come into mating co-planar contact when first tubular member 100 is tightened against adjustment ring 400 when housing 10 has been operably assembled.

In the illustrated embodiment, adjustment ring 400 is formed with a raised wear pad 440, for contact with the walls of the borehole that through which bent housing 10 is passing. It is to be understood, however, that wear pad 440 is not essential to the present disclosure.

As may be appreciated from FIG. 1, adjustable bent housing 10 is typically assembled by the steps of sliding adjustment ring 400 onto internal tubular member 300, with splines 313 engaging grooves 413; threading first end 201 of second tubular member 200 onto second end 302 of internal tubular member 300; and then threading first end 101 of first tubular member 100 onto first end 301 of internal tubular member 300.

Figure 3A:
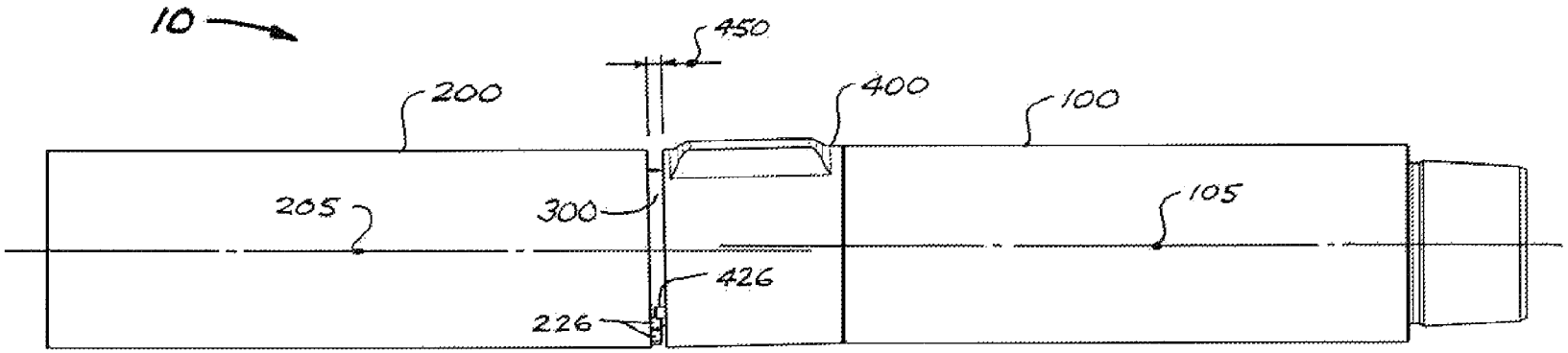
FIG. 3A is a side view of an adjustable bent housing as in FIG. 1, shown in the adjustment configuration and with the indexing pin at a first rotational limit such that the bend angle of the housing is zero.

FIG. 3A shows adjustable bent housing 10 in a first pre-engagement configuration in which the angular offsets between first tubular member 100 and adjustment ring 400, and between second tubular member 200 and adjustment ring 400, are oriented in opposite directions and effectively cancel each other out, such that centroidal axes 105 and 205 of first and second tubular members 100 and 200 are parallel and the bend angle of bent housing 10 is zero.

Figure 3B:
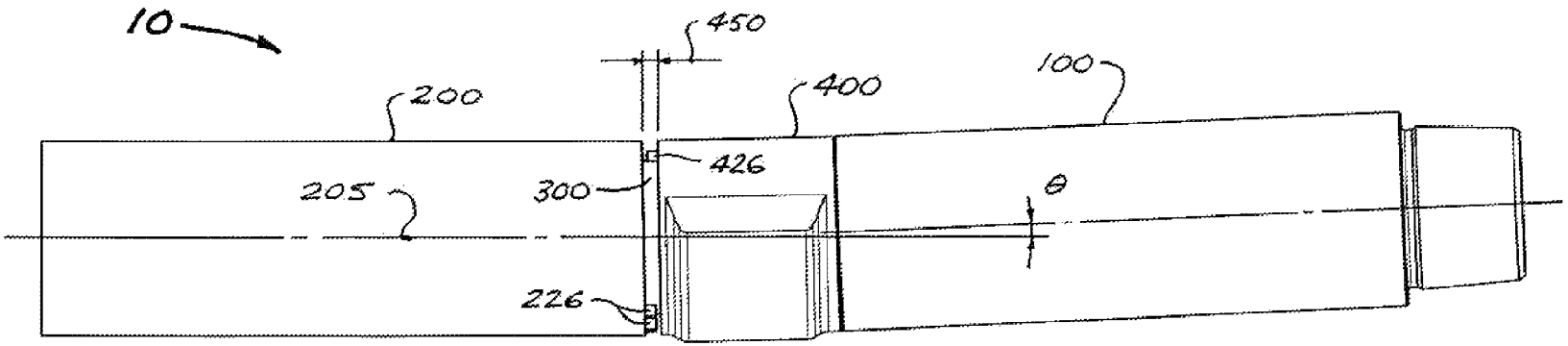
FIG. 3B is a side view of an adjustable bent housing as in FIG. 1, shown in the adjustment configuration and with the indexing pin at a second rotational limit such that the bend angle of the housing is maximized.

FIG. 3B shows adjustable bent housing 10 in a second pre-engagement configuration in which adjustment ring 400 has been rotated to change bend angle $\theta$ to its maximum value. In the illustrated embodiment, this corresponds to a 160-degree rotation of adjustment ring 400 relative to second tubular member 200 (from the configuration of FIG. 3A), with the maximum bend angle $\theta$ being a value slightly less than the sum of first offset angle $\phi_1$ plus second offset angle $\phi_2$. In alternative embodiments of bent housing 10 configured to allow 180-degree rotation of adjustment ring 400 relative to second tubular member 200, the maximum value of bend angle $\theta$ would be equal to the sum of first offset angle $\phi_1$ plus second offset angle $\phi_2$.

FIGS. 4 and 6 illustrate the features of first engagement means 220 incorporated into first end 201 of second tubular member 200, namely:

- a plurality of sockets 224 formed into first region 210-1 of annular end face 210; and
- a plurality of locking pins 226 projecting from second region 210-2 of annular end face 210; with locking pins 226 being centered at a radius R from axis 205, and being equally spaced in an arcuate row at a basic arcuate spacing S;

with the plurality of locking pins 226 including an outer locking pin 226A at each end of the arcuate row, plus a sub-plurality of inner locking pins 226B arrayed between the two outer locking pins 226A, with each outer locking pin 226A projecting a length $L_1$ from end face 210.

As shown in FIGS. 4 to 7, the plurality of sockets 224 may be arcuately staggered from the plurality of similarly spaced locking pins 226, such that the arcuate spacing between each outer locking pin 226 and any socket 224 is other than a multiple of basic spacing S. For certain embodiments in which basic spacing S corresponds to an angular interval equal to 360 degrees divided by an integer (such as in the illustrated embodiments, in which this angular interval is 360/18=20 degrees), the arcuate distance between the center of a given socket 224 and the center of a given locking pin 226 will be equal to (S×(k+q)), where "k" is an integer, and "q" is a selected value greater than zero and less than 1.0 (and preferably equal to approximately 0.5, as shown by way of example in FIGS. 4 to 7).

In alternative embodiments, "q" may be greater or less than 0.5, subject to dimensional constraints relating to pin and socket sizes and basic spacing S. In other embodiments, the arcuate distance between the centers of a given socket 224 and a given locking pin 226 will be equal to (S×k), where "k" is an integer equal to at least 1.0; in such embodiments, the arcuate distance between the centers of a given locking pin 226 and a given socket 224 will be a simple multiple of spacing S (e.g., S×1; S×2; etc.).

In other alternative embodiments, basic spacing S between adjacent locking pins 226 (and therefore between adjacent sockets 224) may correspond to an angular interval other than 360 degrees divided by an integer.

Figure 5:
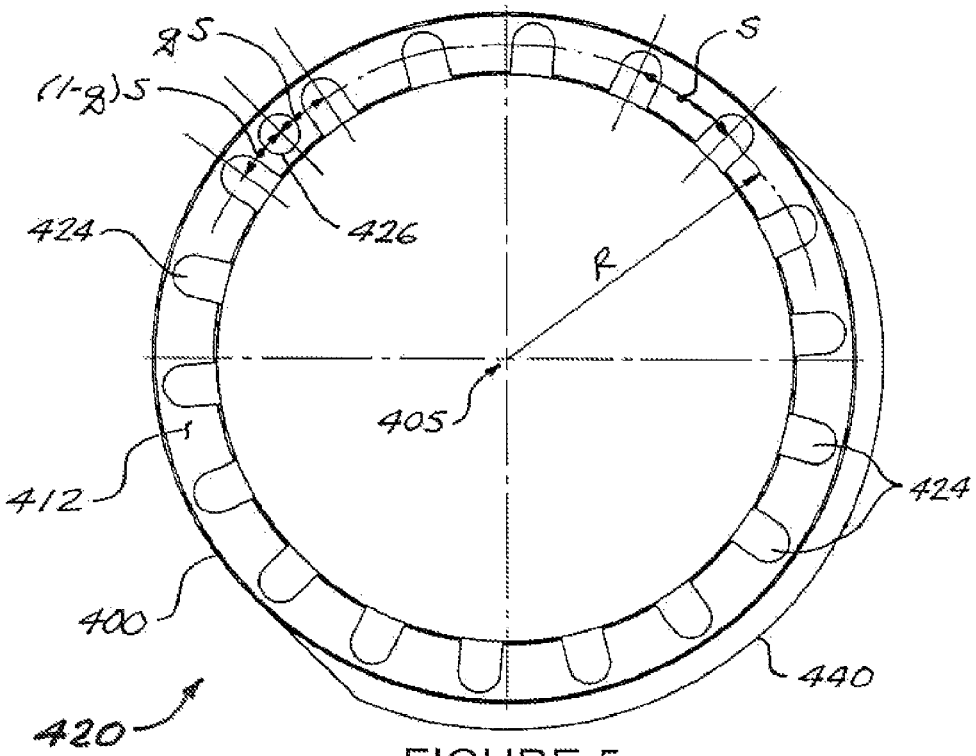
FIG. 5 is an end view of the second end of the adjustment ring of an adjustable bent housing as in FIG. 1.

FIGS. 5 and 7 illustrate the features of second engagement means 420 incorporated into second end 402 of adjustment ring 400, namely:

- a plurality of sockets 424 formed into annular second end face 412 of adjustment ring 400 and sized to receive locking pins 226; and
- an indexing pin 426 projecting a length $L_2$ from end face 412 and sized to be received within any of sockets 224, with indexing pin 426 being centered at radius R from axis 405.

In the illustrated embodiment, indexing pin 426 is located at an arcuate distance equal to (S×(k+q)) from a selected socket 424, with "q" having the same value as it has for purposes of first engagement means 220, such that whenever indexing pin 426 is disposed within or in axial alignment with any socket 224, each locking pin 226 will be disposed within or in axial alignment with one of sockets 424. In alternative embodiments in which the arcuate distance between the centers of a given socket 224 and a given locking pin 226 of the first engagement means is equal to (S×k), where "k" is an integer equal to at least one (1), the arcuate distance between indexing pin 426 and a given socket 424 will be a simple multiple of spacing S (e.g., S×1; S×2; etc.).

Persons skilled in the art will appreciate that the illustrated configuration and geometric relationships of sockets 224, locking pins 226, sockets 424, and indexing pin 426 are by way of example only. The present disclosure is not limited or restricted to any particular configuration or layout of these features, subject only to the proviso that whenever indexing pin 426 is disposed within a given socket 224, each locking pin 226 will be disposed within one of sockets 424. Various different configurations satisfying this proviso may be devised in accordance with the present disclosure.

In particular, it is not essential for sockets 224, locking pins 226, and sockets 424 to be arrayed around the full perimeter of end faces 210 and 412 (as the case may be); variant embodiments having sockets 224, locking pins 226, and sockets 424 arrayed only partially around end faces 210 and 412 (thus providing for a correspondingly lower bend angle adjustment range than in the illustrated embodiments), would come within the principles and scope of the present disclosure.

By way of non-limiting example, although it may be desirable to provide the maximum number of inner locking pins 226B between the two outer locking pins 226A, this is not essential. Strictly speaking, in fact, it is not essential for there to be any inner locking pins 226B between the two outer locking pins 226A, or for each locking pin 226A or 226B to be at the same spacing relative to adjacent locking pins; what is essential is for the arcuate spacing between any two locking pins to correspond to arcuate spacing S or a multiple thereof, such that all locking pins will be disposable into corresponding sockets 424.

Furthermore, although the illustrated embodiments incorporate only one indexing pin 426, alternative embodiments could have two or more indexing pins and yet come within the scope of the disclosure, notwithstanding the resultantly lower bend angle adjustment range.

In the Figures, locking pins 226 and indexing pin 426 are shown as being circular in cross-section. However, the present disclosure is not limited to the use of pins 226 and 426 of circular or any other particular cross-section. Persons of ordinary skill will readily appreciate that although circular pins may be preferable, they could be provided in different geometric configurations (in conjunction with sockets 224 and 424 of complementary configurations) without any substantial effect on the functionality of adjustable bent housings (or other interlocking engagement mechanisms) in accordance with the present disclosure.

In the Figures, locking pins 226 and indexing pin 426 are also shown as being only slightly smaller in diameter than the sockets (424 or 224) into which they may be received; however, this is by way of example only. There is no requirement for a close-tolerance fit between locking pins 226 and indexing pin 426 and receiving sockets 424 and 224, as it is not an essential purpose or function of locking pins 226 and indexing pin 426 to transfer rotational torque. It is in fact desirable for locking pins 226 and indexing pin 426 to have a reasonable amount of clearance within sockets 424 and 224. When adjustable housing 10 is assembled as part of a complete downhole motor, the weight of the components can make it more difficult to rotate the adjustment ring with precision, such that a close-tolerance fit can make it more difficult to line up locking pins 226 and indexing pin 426 with corresponding sockets 424 and 224.

In the illustrated embodiments, sockets 224 and 424 are shown as elongate slots with semi-circular ends. However, the present disclosure is not limited or restricted to sockets 224 and 424 of this or any other particular configuration. Sockets 224 and 424 could be provided in various other configurations, including (by way of non-limiting example) circular or ovate shapes, without departing from the scope of the present disclosure.

The purpose of locking pins 226 and indexing pin 426 is to interlock adjustment ring 400 and second tubular member 200 in a selected relative position as make-up torque is applied to the threaded connection between first tubular member 100 and internal tubular member 300. The size and number of locking pins 226 and indexing pin (or pins) 426 needs to be sufficient to withstand the torque required to hold adjustment ring 400 and second tubular member 200 from sliding relative to each other during make-up of the connection. However, once the connection is made up, torque transfer between the components of the assembly will be achieved through friction between the threads and mating annular faces of the preloaded connections at each end of adjustment ring 400.

The longitudinal travel range 450 of adjustment ring 400 relative to second tubular member 200 must of course be greater than both locking pin length $L_1$ and indexing pin length $L_2$ so that locking pins 226 and indexing pin 426 can be fully withdrawn from sockets 424 and 224 respectively. As best seen in FIGS. 3A and 3B, however, travel range 450 is limited to a maximum distance sufficiently less than the sum of $L_1$ plus $L_2$ such that the outer locking pins 226A act as stops or bumpers for indexing pin 426, thus limiting the rotational travel range of adjustment ring 400 (and, in turn, inner tubular member 300) relative to second tubular member 200, to a range corresponding to first region 210-1 of annular end face 210 of second tubular member 200 (i.e., the region having sockets 224 and extending between the two outer locking pins 226A).

Restriction of travel range 450 to an appropriate maximum distance may be accomplished by any suitable means. One way to restrict travel range 450 is by way of instructions to users. In one embodiment, for example, locking pins 226 and indexing pin 426 are each 0.375 inches long, and the pitch of internal threads 111 and external threads 311 is such that each rotation of first tubular member 100 relative to internal tubular member 300 corresponds to a 0.25-inch axial displacement of first tubular member 100 relative to internal tubular member 300. Accordingly, users may be instructed to rotate first tubular member 100 only two full rotations relative to internal tubular member 300 when preparing to adjust bend angle θ of the adjustable housing. This will produce a gap of 0.50 inches between first tubular member 100 and internal tubular member 300, thereby allowing second end face 412 of adjustment ring 400 to be moved 0.50 inches away from end face 210 of second tubular member 200. This separation is sufficient to withdraw locking pins 226 clear from second end face 412 and to withdraw indexing pin 426 clear from end face 210. However, it is less than the separation that would be necessary (i.e., at least 0.75 inches) to permit free rotation of adjustment ring 400 without interference between locking pins 226 and indexing pin 426, while leaving an ample safety factor or buffer (i.e., one full rotation) against inadvertent over-rotation of first tubular member 100 relative to internal tubular member 300.

If it is desired to eliminate all possibility of human error in this regard, stop means may be provided for physically limiting the extent to which adjustment ring 400 can be slidingly moved along internal tubular member 300 toward first tubular member 100. By way of non-limiting example, a stop element could be provided between threads 311 and splines 313 of internal tubular member 300 to limit travel of adjustment ring 400 along internal tubular member 300, irrespective of the extent to which first tubular member 100 is rotated relative to internal tubular member 300. Alternatively, a stop element could be provided in the form of a split ring disposed within a circumferential groove in internal tubular member 300. Persons skilled in that art will appreciate that travel range 450 of adjustment ring 400 can be restricted in a variety of ways without departing from the present disclosure, which is not limited to the use of any particular means or method for doing so.

In the illustrated embodiments, basic arcuate spacing S corresponds to a selected angular interval of 20 degrees, such that second engagement means 420 can have a maximum of 18 sockets 424 (as shown in FIGS. 5 and 7). It follows that the maximum total number of sockets 224 and locking pins 226 in first engagement means 220 will be 19 (as shown in FIGS.

4 and 6), due to the staggered spacing of sockets 224 relative to locking pins 226. In the illustrated embodiments, first engagement means 220 has 9 sockets 224 and 10 locking pins 226. Although this particular configuration may be preferable or desirable from an operative standpoint, it is exemplary only. In alternative embodiments, first engagement means 220 could conceivably have, for example, 10 sockets 224 and 9 locking pins 226 (or, for another example, 8 sockets 224 and 11 locking pins 226), and still be operably engageable with the particular embodiment of second engagement means 420 shown in FIGS. 5 and 7 (although with different rotational travel limits, and with bent housing 10 having correspondingly different bend angle adjustment ranges).

In fact, and as previously indicated, it is not essential for indexing pin 426 to be positioned between two adjacent sockets 424 as shown in FIGS. 5 and 7. In alternative embodiments, indexing pin 426 could be located an arcuate distance S from the adjacent sockets 424 to either side, such that there would be one less socket 424 than in the illustrated embodiments (e.g., for a basic arcuate spacing S corresponding to a 20-degree angular interval, there would be only 17 sockets 424). In that alternative embodiment, the center of each outer locking pin 226A would be at an arcuate spacing S from the adjacent socket 224, and there would be a combined total of 18 sockets 224 and locking pins 226.

Figure 8:
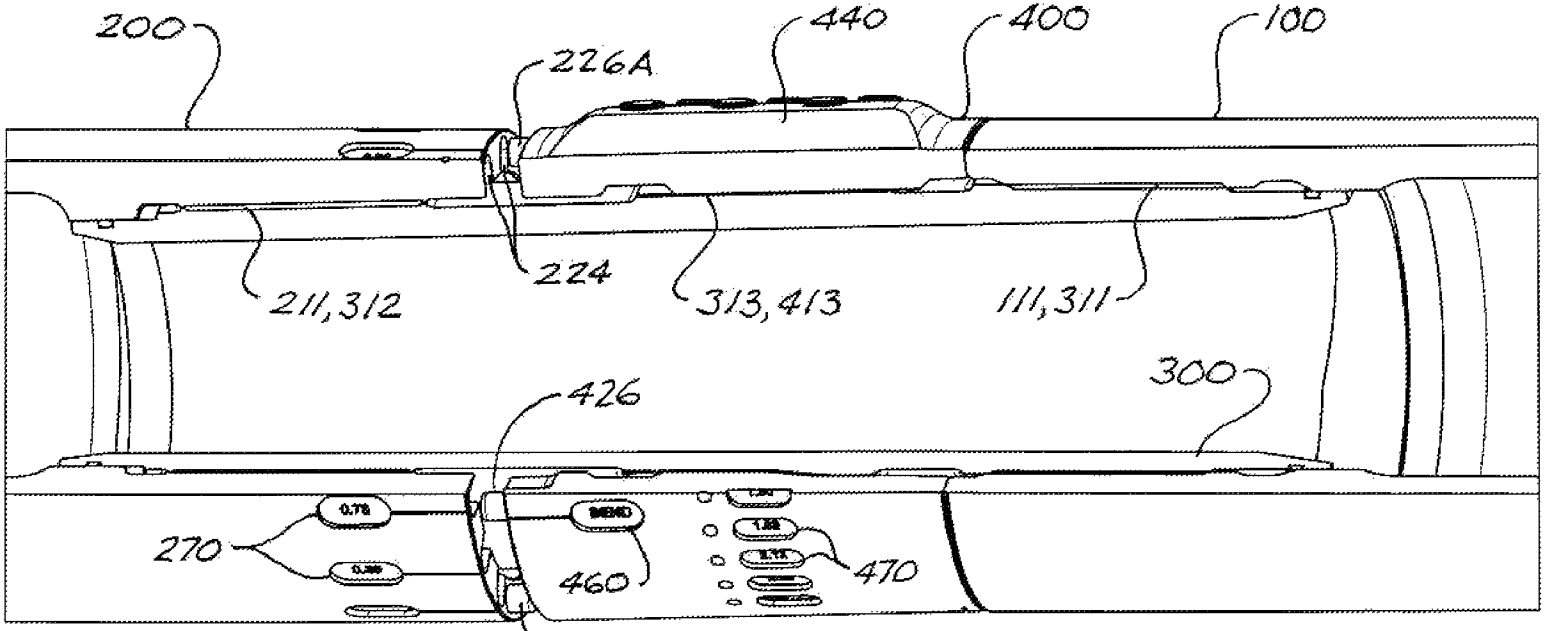
FIG. 8 is a partial-cutaway isometric view of an adjustable bent housing and interlocking engagement mechanism as in FIG. 1, with the mechanism in the adjustment position.

It is typically desirable for an adjustable bent housing to have markings to indicate the bend angle at which the housing has been set, and to facilitate adjusting the bend angle to a new value. FIGS. 6, 7, and 8 provide examples of such markings for use with adjustable bent housings having interlocking engagement means in accordance with the present disclosure. As shown in FIGS. 6 and 8, a series of bend angle marks 270 are provided on the outer surface of second tubular member 200 near first end 201 thereof, each bend angle mark 270 being aligned with a particular socket 224, and indicating a particular bend angle. As shown in FIGS. 7 and 8, a bend angle index mark 460 is provided on the outer surface of adjustment ring 400 near second end 402 thereof, aligned with indexing pin 426. The bend angle θ may then be determined by reading the bend angle mark 270 that is aligned with bend angle index mark 460.

Also as shown in FIGS. 7 and 8, adjustment ring 400 may also be provided with bend plane marks 470 to indicate the location of the plane of the bend based on the bend angle setting. Such marks are typically necessary for purposes of MWD ("measurement-while-drilling") operations in order to determine the orientation of the bend in the downhole motor, and thus be able to control the resulting direction of drilling. For each bend angle setting, the resulting plane of the bend in the assembly is different. Relative to adjustment ring 400, the angular change in the bend plane between successive bend angle settings is equal to half the angular interval between bend angle settings.

For example, the incremental bend plane change would be 10 degrees for the illustrated embodiment, in which the angular interval between bend angle settings is 20 degrees). For a given bend angle setting, the bend plane can be located by finding the bend plane mark 470 corresponding to the selected bend angle mark 270 (i.e., adjacent to bend angle index mark 460). For example, if the bend angle θ is set at 1.50 degrees, the corresponding bend plane will pass through axis 405 of adjustment ring 400 and the 1.50-degree bend angle mark 270 on adjustment ring 400).

It should be understood, however, that bend angle markings and bend plane markings can be provided in a variety of ways, and that the illustrated markings are exemplary only. It should be further understood that although such markings may be desirable or even necessary in some cases, they are not essential to the present disclosure.

Operation and use of adjustable bent housing 10 in accordance with the present disclosure may be readily understood with reference to the preceding description. When bent housing 10 has been set at a particular bend angle, with first and second engagement means 220 and 420 interlockingly engaged, and it is desired to change the bend angle to a new value, the first step is to rotate first tubular member 100 so as to partially disengage internal threads 111 of first tubular member 100 from external threads 311 of internal member 300, so as to move first tubular member 100 longitudinally away from second tubular member 200 a distance equal to at least the greater of pin lengths $L_1$ and $L_2$, but not exceeding the maximum travel range 450.

Adjustment ring 400 can then be moved longitudinally along internal tubular member 300 toward first tubular member 100 so as to disengage locking pins 226 of first engagement means 220 from corresponding sockets 424 of second engagement means 420, and to disengage indexing pin 426 of second engagement means 420 from a corresponding socket 224 of first engagement means 220.

Adjustment ring 400 is then rotated as appropriate relative to second tubular member 200 (and in the process rotating internal tubular member 300 relative to second tubular member 200 due to the engagement of external threads 312 of internal tubular member 300 and internal threads 211 of second tubular member 200), so as to change the bend angle of bent housing 10 to a selected new value, having reference to bend angle index mark 460 on adjustment ring 400 and bend angle marks 270 on second tubular member 200. Because the travel range 450 of adjustment ring 400 relative to second tubular member 200 is restricted as previously described, the rotational travel range of adjustment ring 400 is correspondingly restricted to the angular interval between the two outer locking pins 226A, which will act as "stoppers" for indexing pin 426 during bend angle adjustment, thus preventing potentially damaging over-rotation.

With bend angle index mark 460 aligned with a bend angle mark 270 corresponding to the desired new bend angle setting, adjustment ring 400 is then moved back toward second tubular member 200 until locking pins 226 of first engagement means 220 are engaged within corresponding sockets 424 of second engagement means 420, and indexing pin 426 of second engagement means 420 is engaged within a corresponding socket 224 of first engagement means 220. First tubular member 100 is then rotated relative to internal tubular member 300 so as to bring planar end face 110 of first tubular member 100 into tight mating contact with planar end face 410 at first end 401 of adjustment ring 400. Adjustable bent housing 10 has now been adjusted to the selected new bend angle, and is ready to be returned to service in well drilling operations.

It will be readily appreciated by those skilled in the art that various modifications of the present disclosure may be devised without departing from the essential concept of the disclosure, and all such modifications are intended to come within the scope of the present disclosure and the claims appended hereto. By way of non-limiting example, the first and second engagement means as described above could be interchanged, such that the first engagement means incorporated into the first end of the second tubular member comprises an indexing pin and a plurality of sockets, while the second engagement means incorporated into the second end of the adjustment ring comprises a plurality of sockets formed in a first region of the annular second end face of the adjustment ring, plus a plurality of locking pins projecting from a second region of the annular second end face of the adjustment ring.

By way of a further non-limiting example, although indexing pin 426 in the described and illustrated embodiments is located on a circle having the same radius as locking pins 226, this is not essential to the disclosure. In alternative embodiments, indexing pin 426 and corresponding sockets 224 on first end face 210 of second tubular member 200 could be located at one radius, with locking pins 226 and corresponding sockets 424 on adjustment ring 400 being located at a second radius. For that matter, it is not essential for all locking pins 226 to be located at the same radius, so long as they are spaced at the same basic angular interval (or multiples thereof), and so long as sockets 424 are sized such that they can receive all locking pins 226 for every possible position of indexing pin 426.

It is to be especially understood that the disclosure is not intended to be limited to illustrated embodiments, and that the substitution of a variant of a claimed element or feature, without any substantial resultant change in the working of the embodiments, will not constitute a departure from the scope of the disclosure.

In particular, it is to be understood that the principles of the present disclosure are readily adaptable for use in conjunction with adjustable bent housing assemblies having configurations different from the illustrated embodiments. For example, whereas in the illustrated embodiments first end face 410 of adjustment ring 400 is offset relative to axis 405, and second end 412 is perpendicular to axis 405, in alternative embodiments first end face 410 of adjustment ring 400 could be perpendicular relative to axis 405, and second end 412 could be offset to axis 405. In such alternative embodiments, the configuration of internal tubular member 300 may require modifications from the illustrated embodiment thereof, but the nature of such required modifications will be readily apparent to persons skilled in the art.

What is claimed is:

1. An interlocking engagement mechanism for rotationally engaging a first tubular member with a second tubular member, said first and second tubular members each having a first end and a planar annular end face, wherein said interlocking engagement mechanism comprises:

a first engagement means comprising:

a plurality of sockets formed in a first region of the annular end face of the first tubular member; and a plurality of locking pins projecting from a second region of the annular end face of the first tubular member, said locking pins being arrayed in a circularly curved pattern at a radius "R" and equally spaced at an arcuate spacing "S";

a second engagement means comprising:

a plurality of sockets formed in the annular end face of the second tubular member, said sockets being configured such that any locking pin of the first engagement means is receivable within any socket of the second engagement means, and an indexing pin projecting from the annular end face of the second tubular member, said indexing pin being configured to be receivable within any socket of the first engagement means; and a means for allowing relative longitudinal movement and relative angular displacement between the first and second tubular members to enable engagement and disengagement of the first and second engagement means such that whenever the indexing pin is disposed within a selected socket of the first engagement means, each locking pin will be disposed within a socket of the second engagement means.

2. The interlocking engagement mechanism of claim 1 wherein the means for allowing relative longitudinal movement and relative angular displacement between the first and second tubular members comprises:

an internal tubular member disposed within the bore of the second tubular member, and having a first end rotatably engageable with the first end of the first tubular member, said internal tubular member having longitudinal splines projecting radially outward from an outer cylindrical surface of the internal tubular member; and longitudinal grooves formed into an inner cylindrical surface of the second tubular member, said grooves being configured for sliding engagement with the splines of the internal tubular member, such that the second tubular member is longitudinally movable but non-rotatable relative to the internal tubular member.

3. The interlocking engagement mechanism of claim 2 wherein the longitudinal movability of the second tubular member relative to the internal tubular member is limited to a distance less than a sum of a projecting length of the indexing pin and a maximum projecting length of the locking pins.

4. The interlocking engagement mechanism of claim 1 wherein the means for allowing relative longitudinal movement and relative angular displacement between the first and second tubular members comprises:

an internal tubular member disposed within the bore of the first tubular member, and having a first end rotatably engageable with the first end of the second tubular member, said internal tubular member having longitudinal splines projecting radially outward from an outer cylindrical surface of the internal tubular member; and longitudinal grooves formed into an inner cylindrical surface of the first tubular member, said grooves being configured for sliding engagement with the splines of the internal tubular member, such that the first tubular member is longitudinally movable but non-rotatable relative to the internal tubular member.

5. The interlocking engagement mechanism of claim 4 wherein the longitudinal movability of the first tubular member relative to the internal tubular member is limited to a distance less than a sum of a projecting length of the indexing pin and a maximum projecting length of the locking pins.

6. The interlocking engagement mechanism of claim 1, wherein:

an arcuate distance between a center of any locking pin and a center of any socket of the first engagement means is a multiple of arcuate spacing "S"; and an arcuate distance between a center of the indexing pin and a center of any socket of the second engagement means is a multiple of arcuate spacing "S".

7. The interlocking engagement mechanism of claim 1, wherein:

an arcuate distance between a center of any locking pin and a center of any socket of the first engagement means is equal to "S" times ("k"+"q"), where "k" is an integer, and "q" is a selected value greater than zero and less than 1.0; and an arcuate distance between a center of the indexing pin and a center of any socket of the second engagement means is equal to "S" times ("k"+"q").

8. An adjustable bent housing comprising:

a first tubular member having a first centroidal axis, a first end, and a planar annular first end face;

a second tubular member having a second centroidal axis, a skew axis offset from the second centroidal axis by a first offset angle, a first end, and a planar annular first end face incorporating first engagement means;

a tubular sleeve having a third centroidal axis, a first end, a planar annular first end face, a second end, and a planar annular second end face, said second end face incorporating second engagement means; and an internal tubular member having a first end, a first end portion, a second end, a second end portion, and a medial portion between said first and second end portions;

wherein:

the tubular sleeve is disposed around the internal tubular member in association with means whereby the tubular sleeve is longitudinally movable but non-rotatable relative to the internal tubular member;

the first end of the internal tubular member has external threads engageable with mating internal threads in the first end of the first tubular member such that:

the first end face of the first tubular member is parallel to the first end face of the tubular sleeve;

the first centroidal axis is offset from the skew axis by a second offset angle; and the first end face of the second tubular member is parallel to the second end face of the tubular sleeve;

the first engagement means comprises:

a plurality of sockets formed in a first region of the first end face of the second tubular member; and a plurality of locking pins projecting from a second region of the first end face of the second tubular member, said locking pins being arrayed in a circularly curved pattern at a radius "R" and equally spaced at an arcuate spacing "S";

the second engagement means comprises:

a plurality of sockets formed in the second end face of the tubular sleeve; and an indexing pin projecting from the second end face of the tubular sleeve;

each locking pin is receivable within any socket of the second engagement means; and the indexing pin is receivable within any socket of the first engagement means;

such that whenever the indexing pin is disposed within a socket of the first engagement means, each locking pin will be disposed within a socket of the second engagement means.

9. The adjustable bent housing of claim 8 wherein the longitudinal movability of the tubular sleeve relative to the internal tubular member is restricted to a distance less than a sum of a projecting length of the indexing pin and a maximum projecting length of the locking pins.

10. The adjustable bent housing of claim 8 wherein the means whereby the tubular sleeve is non-rotatable and longitudinally movable relative to the internal tubular member comprises:

longitudinal splines projecting radially outward from the medial portion of the internal tubular member; and longitudinal grooves formed into an inner surface of the tubular sleeve, a said grooves being configured for sliding engagement with said splines.

11. The adjustable bent housing of claim 8, wherein:

an arcuate distance between a center of any locking pin and a center of any socket of the first engagement means is a multiple of arcuate spacing "S"; and an arcuate distance between a center of the indexing pin and a center of any socket of the second engagement means is a multiple of arcuate spacing "S".

12. The adjustable bent housing of claim 8, wherein:

an arcuate distance between a center of any locking pin and a center of any socket of the first engagement means is equal to "S" times ("k"+"q"), where "k" is an integer, and "q" is a selected value greater than zero and less than 1.0; and an arcuate distance between a center of the indexing pin and a center of any socket of the second engagement means is equal to "S" times ("k"+"q").

13. An adjustable bent housing comprising:

a first tubular member having a first centroidal axis, a first end, and a planar annular first end face;

a second tubular member having a second centroidal axis, a skew axis offset from the second centroidal axis by a first offset angle, a first end, and a planar annular first end face incorporating first engagement means;

a tubular sleeve having a third centroidal axis, a first end, a planar annular first end face, a second end, and a planar annular second end face, said second end face incorporating second engagement means; and an internal tubular member having a first end, a first end portion, a second end, a second end portion, and a medial portion between said first and second end portions;

wherein:

the tubular sleeve is disposed around the internal tubular member in association with means whereby the tubular sleeve is longitudinally movable but non-rotatable relative to the internal tubular member;

the first end of the internal tubular member has external threads engageable with mating internal threads in the first end of the first tubular member such that:

the first end face of the first tubular member is parallel to the first end face of the tubular sleeve;

the first centroidal axis is offset from the skew axis by a second offset angle; and the first end face of the second tubular member is parallel to the second end face of the tubular sleeve;

the first engagement means comprises:

a plurality of sockets formed in the first end face of the second tubular member; and an indexing pin projecting from the first end face of the second tubular member;

the second engagement means comprises:

a plurality of sockets formed in a first region of the second end face of the tubular sleeve; and a plurality of locking pins projecting from a second region of the second end face of the tubular sleeve, said locking pins being centered at a radius "R" from the third centroidal axis and equally spaced at an arcuate spacing "S";

each locking pin is receivable within any socket of the first engagement means; and the indexing pin is receivable within any socket of the second engagement means;

such that whenever the indexing pin is disposed within a socket of the second engagement means, each locking pin will be disposed within a socket of the first engagement means.

14. The adjustable bent housing of claim 13 wherein the longitudinally movability of the tubular sleeve relative to the internal tubular member is restricted to a distance less than a sum of a projecting length of the indexing pin and a maximum projecting length of the locking pins.

15. The adjustable bent housing of claim 13 wherein the means whereby the tubular sleeve is non-rotatable and longitudinally movable relative to the internal tubular member comprises:

longitudinal splines projecting radially outward from the medial portion of the internal tubular member; and longitudinal grooves formed into an inner surface of the tubular sleeve, a said grooves being configured for sliding engagement with said splines.

16. The adjustable bent housing of claim 13, wherein:

an arcuate distance between a center of any locking pin and a center of any socket of the first engagement means is a multiple of arcuate spacing "S"; and an arcuate distance between a center of the indexing pin and a center of any socket of the second engagement means is a multiple of arcuate spacing "S".

17. The adjustable bent housing of claim 13, wherein:

an arcuate distance between a center of any locking pin and a center of any socket of the first engagement means is equal to "S" times ("k"+"q"), where "k" is an integer, and "q" is a selected value greater than zero and less than 1.0; and an arcuate distance between a center of the indexing pin and a center of any socket of the second engagement means is equal to "S" times ("k"+"q").

18. An adjustable bent housing comprising:

a first tubular member having a first centroidal axis and;

a first end having a planar annular first end face perpendicular to said first centroidal axis; and first internal threads concentric with the first centroidal axis in a region of the first tubular member proximal to the first end thereof;

a second tubular member having a second centroidal axis and;

a first end having a planar annular first end face angularly offset from a plane perpendicular to said second centroidal axis by a first offset angle;

a skew axis angularly offset the second centroidal axis by said first offset angle;

second internal threads concentric with the skew axis in a region of the second tubular member proximal to the first end thereof; and first engagement means incorporated into the first end of the second tubular member;

a tubular sleeve having a third centroidal axis, a first end with a planar annular first end face, and a second end having a planar annular second end face, wherein:

the plane of said first end face of the tubular sleeve is angularly offset from a plane perpendicular to the third centroidal axis by a second offset angle;

the plane of the second end face of the tubular sleeve is perpendicular to the third centroidal axis; and said second end of the tubular sleeve incorporates second engagement means engageable with the first engagement means; and an internal tubular member having a first end portion and a second end portion, plus a medial portion between said first and second end portions, wherein:

said first portion has a fourth centroidal axis; and said second portion has a fifth centroidal axis angularly offset from the fourth centroidal axis by the second offset angle;

said internal tubular member further having:

first external threads concentric with the fourth centroidal axis in a region proximal to the first end of the internal tubular member, said first external threads being engageable with the first internal threading of the first tubular member; and second external threads concentric with the fifth centroidal axis in a region proximal to the second end of the internal tubular member, said second external threads being engageable with the second internal threads of the second tubular member;

wherein:

the tubular sleeve is disposed around the internal tubular member with means provided whereby the tubular sleeve is non-rotatable and longitudinally movable relative to the internal tubular member;

the first engagement means comprises:

a plurality of sockets formed in a first region of the first end face of the second tubular member; and a plurality of locking pins projecting from a second region of the first end face of the second tubular member, said locking pins being centered at a radius "R" from the second centroidal axis and equally spaced at an arcuate spacing "S";

the second engagement means comprises:

a plurality of sockets formed in the second end face of the tubular sleeve; and an indexing pin projecting from the second end face of the tubular sleeve;

each locking pin is receivable within any socket of the second engagement means; and the indexing pin is receivable within any socket of the first engagement means;

such that whenever the indexing pin is disposed within a socket of the first engagement means, each locking pin will be disposed within a socket of the second engagement means.

19. The adjustable bent housing of claim 18 wherein the longitudinal movability of the tubular sleeve relative to the internal tubular member is restricted to a distance less than a sum of a projecting length of the indexing pin and a maximum projecting length of the locking pins.

20. The adjustable bent housing of claim 18 wherein the means whereby the tubular sleeve is non-rotatable and longitudinally movable relative to the internal tubular member comprises:

longitudinal splines projecting radially outward from the medial portion of the internal tubular member; and longitudinal grooves formed into an inner surface of the tubular sleeve, a said grooves being configured for sliding engagement with said splines.

21. The adjustable bent housing of claim 18, wherein:

an arcuate distance between a center of any locking pin and a center of any socket of the first engagement means is a multiple of arcuate spacing "S"; and an arcuate distance between a center of the indexing pin and a center of any socket of the second engagement means is a multiple of arcuate spacing "S".

22. The adjustable bent housing of claim 18, wherein:

an arcuate distance between a center of any locking pin and a center of any socket of the first engagement means is equal to "S" times ("k"+"q"), where "k" is an integer, and "q" is a selected value greater than zero and less than 1.0; and an arcuate distance between a center of the indexing pin and a center of any socket of the second engagement means is equal to "S" times ("k"+"q").

23. An adjustable bent housing comprising:

a first tubular member having a first centroidal axis and;

a first end having a planar annular first end face perpendicular to said first centroidal axis; and first internal threads concentric with the first centroidal axis in a region of the first tubular member proximal to the first end thereof;

a second tubular member having a second centroidal axis and;

a first end having a planar annular first end face angularly offset from a plane perpendicular to said second centroidal axis by a first offset angle;

a skew axis angularly offset the second centroidal axis by said first offset angle;

second internal threads concentric with the skew axis in a region of the second tubular member proximal to the first end thereof; and first engagement means incorporated into the first end of the second tubular member;

a tubular sleeve having a third centroidal axis, a first end with a planar annular first end face, and a second end having a planar annular second end face, wherein:

the plane of said first end face of the tubular sleeve is angularly offset from a plane perpendicular to the third centroidal axis by a second offset angle;

the plane of the second end face of the tubular sleeve is perpendicular to the third centroidal axis; and said second end of the tubular sleeve incorporates second engagement means engageable with the first engagement means; and an internal tubular member having a first end portion and a second end portion, plus a medial portion between said first and second portions, wherein:

said first portion has a fourth centroidal axis; and said second portion has a fifth centroidal axis angularly offset from the fourth centroidal axis by the second offset angle;

said internal tubular member further having:

first external threads concentric with the fourth centroidal axis in a region proximal to the first end of the internal tubular member, said first external threads being engageable with the first internal threading of the first tubular member; and second external threads concentric with the fifth centroidal axis in a region proximal to the second end of the internal tubular member, said second external threads being engageable with the second internal threads of the second tubular member;

wherein:

the tubular sleeve is disposed around the internal tubular member with means provided whereby the tubular sleeve is non-rotatable and longitudinally movable relative to the internal tubular member;

the first engagement means comprises:

a plurality of sockets formed in the first end face of the second tubular member; and an indexing pin projecting from the first end face of the second tubular member;

the second engagement means comprises:

a plurality of sockets formed in a first region of the second end face of the tubular sleeve; and a plurality of locking pins projecting from a second region of the second end face of the tubular sleeve, said locking pins being centered at a radius "R" from the third centroidal axis and equally spaced at an arcuate spacing "S";

each locking pin is receivable within any socket of the first engagement means; and the indexing pin is receivable within any socket of the second engagement means;

such that whenever the indexing pin is disposed within a socket of the second engagement means, each locking pin will be disposed within a socket of the first engagement means.

24. The adjustable bent housing of claim 23 wherein the longitudinally movability of the tubular sleeve relative to the internal tubular member is restricted to a distance less than a sum of the projecting length of the indexing pin and a maximum projecting length of the locking pins.

25. The adjustable bent housing of claim 23 wherein the means whereby the tubular sleeve is non-rotatable and longitudinally movable relative to the internal tubular member comprises:

longitudinal splines projecting radially outward from the medial portion of the internal tubular member; and longitudinal grooves formed into an inner surface of the tubular sleeve, a said grooves being configured for sliding engagement with said splines.

26. The adjustable bent housing of claim 23, wherein:

an arcuate distance between a center of any locking pin and a center of any socket of the first engagement means is a multiple of arcuate spacing "S"; and an arcuate distance between a center of the indexing pin and a center of any socket of the second engagement means is a multiple of arcuate spacing "S".

27. The adjustable bent housing of claim 23, wherein:

an arcuate distance between a center of any locking pin and a center of any socket of the first engagement means is equal to "S" times ("k"+"q"), where "k" is an integer, and "q" is a selected value greater than zero and less than 1.0; and an arcuate distance between a center of the indexing pin and a center of any socket of the second engagement means is equal to "S" times ("k"+"q").

* * * * *